United States Patent [19]

Cooksey et al.

[11] 4,072,457

[45] Feb. 7, 1978

[54] SPIN POT WITH IMPROVED TOP CAP

[75] Inventors: James Judson Cooksey, Colonial Heights; Garland Linwood Turner, Chesterfield, both of Va.

[73] Assignee: Allied Chemical Corporation, Morris Township, N.J.

[21] Appl. No.: 760,880

[22] Filed: Jan. 21, 1977

Related U.S. Application Data

[63] Continuation-in-part of Ser. No. 612,389, Sept. 11, 1975, abandoned.

[51] Int. Cl.[2] ..... D01D 3/00

[52] U.S. Cl. ..... 425/192 S; 425/198; 425/191

[58] Field of Search ..... 425/192 S, 198, 199, 425/382.2, 464, 191 S

[56] References Cited

U.S. PATENT DOCUMENTS 3,437,725 4/1969 Pierce ..... 425/198 X 3,938,925 2/1976 Lees ..... 425/382.2 X

FOREIGN PATENT DOCUMENTS 15,445 7/1965 Japan ..... 425/198

*Primary Examiner*—Robert D. Baldwin

*Attorney, Agent, or Firm*—Richard A. Anderson

[57] ABSTRACT

A spin pot, for the extrusion of one or more ends of multifilament, synthetic fibers, which essentially eliminates all stagnant zones caused by nonuniform flow patterns while yielding yarns of high quality at high extrusion rates for an extended period between spin pot changes. "Plug flow" is achieved throughout the passage of polymer through the spin pot by the design of the internal parts wherein: the optimum number and location of polymer delivery channels in the top cap are defined, polymer flow throughout the spin pot is streamlined, and improved sealing characteristics are provided by the design of the top cap and the breaker plate.

11 Claims, 2 Drawing Figures

SPIN POT WITH IMPROVED TOP CAP

BACKGROUND OF THE INVENTION

This is a continuation-in-part of application Ser. No. 612,389, filed Sept. 11, 1975, now abandoned.

This invention relates to an apparatus for the extrusion of synthetic filaments. In particular, it relates to a spin pot for the melt spinning of artificial filaments from thermoplastic materials such as nylon and polyester.

Although it will be understood from the following description that the present invention may be successfully used to produce fibers from various materials, it is nevertheless particularly applicable to the production of synthetic polymer fibers, and, accordingly, stress will be placed on the use of polymer in the following description.

Conventional spin pots comprise a top cap, a filter assembly formed by a series of fine metal gauzes or fine refractory material which are usually held in position by metal retaining gauzes, an optional perforated breaker plate arranged so as to maximize mixing and minimize stagnation of the polymer and which supports the metal retaining gauzes of the filter assembly, an optional filter positioned next downstream from the breaker plate, a spinnerette plate provided with extrusion orifices and to which the melt is passed from the optional filter or directly from the breaker plate, and a spin pack body which supports the spinnerette plate.

The demand for higher yields at higher throughput rates must be balanced with the economics of existing space limitations. In multiple end spinning, where the number of extrusion orifices is greatly increased while the dimensions of the spinnerette plate remain substantially unchanged, problems arise in the quench zone due to crowding of the filaments. Therefore it is desirable, for both single and multiple end spinning, to maximize the internal wetted area of the spin pot while utilizing existing space. By "internal wetted area" is meant that portion of the spin pot through which polymer flows subsequent to the top cap. U.S. Pat. Nos. 3,050,774, 3,437,725 and 3,488,806 exemplify spin pots wherein the conventional, cup-shaped spin pack body has been eliminated (see their respective drawings). The major elements are sandwiched together, often with seals therebetween, and are connected by a plurality of bolts, at least one of which passes through the periphery and/or center of the spinnerette plate. The primary problem associated with passing bolts through the spinnerette plate, whether their function be supportive or connective, is deformation of the spinnerette plate. During extrusion, bolt threads in a spinnerette plate become damaged, and the spinnerette plate must be discarded. As the spinnerette plate is a delicate, precision instrument, this is a quite expensive and unnecessary waste. Also, the area occupied by bolts positioned other than at the periphery of the major spin pot elements is wasted space that could be utilized as wetted area in order to maximize production.

There are also several other critical areas in the spin pot. In the volume between the filter and the top cap, polymer tends to fill the space above the peripheral binder of the filter. The polymer becomes thermally degraded in varying degrees before being swept back in toward the center of the spin pot where it creates an undesirable viscosity gradient. This can eventually result in a break in extrusion and/or the formation of weak points in the filament. There may also be an external leakage problem due to inefficient sealing of the volume between the filter and the top cap. This will result in polymer oozing down the sides of the spin pot to interfere with the yarn path, frequently dripping onto the filaments being produced and rendering them unfit. Under these circumstances, polymer will be lost, and spinning will have to be interrupted to correct the problem.

The number, size, and location of polymer delivery channels in the top cap is also extremely critical. In top caps having an inverted cone type of delivery channel, a greater amount of polymer tends to flow through the center due to the pressure differential, resulting in nonuniform polymer distribution over the face of the filter. See, for example, U.S. Pat. Nos. 3,299,470 (FIG. 2) and 3,509,598 (FIG. 1). Similar results obtain with top caps having delivery channels of similar cross-sectional areas but with varying lengths. The unequal flow pattern causes variable residence times which in turn cause filament nonuniformity.

Increased residence time leads to degradation of the polymer. Thermoplastic materials, such as nylon and polyester, are highly sensitive to temperatures and pressures present in a spin pot, and their viscosity and chemical characteristics change with time under these conditions.

The spin pot of the present invention essentially eliminates all of the aforementioned problems and yields yarns of high quality at high rates for an extended period between spin pot changes. The internal parts are designed so that plug flow of the polymer is achieved through the spin pot. "Plug flow" occurs when all volume elements of the polymer maintain their relative positions, within fairly narrow limits, throughout the spin pot subsequent to passage through the distribution space above the breaker plate, and when all volume elements of the polymer have substantially the same residence time through the spin pot.

SUMMARY OF THE INVENTION

The present invention provides a spin pot which comprises superimposed top cap, filter assembly, breaker plate, spinnerette plate, and flange means. The top cap and filter assembly are positioned so as to form a distribution space therebetween, and the breaker plate and spinnerette plate are positioned so as to form a distribution space therebetween. The present invention comprises the improvement of connecting the top cap, the breaker plate, and the flange means vertically through their respective peripheral boundaries only. The need for a conventional, cup-shaped spin pack body is obviated by this improved spin pot, and as a consequence, use of the same maximizes utilization of existing space heretofore occupied by a spin pack body. Surprisingly, no other means of connection are necessary.

A top cap is provided for use in the aforementioned spin pot, or for use in conjunction with a conventional spin pack assembly, for the extrusion of synthetic filaments. The essential elements are a flow inlet passage and a plurality of polymer delivery channels. The flow inlet passage brings molten polymer to an area, the central axis of which substantially coincides with the central axis of the top cap. The delivery channels communicate with the flow inlet passage at this area and branch radially therefrom at substantially equal intervals through the top cap to open at the lower surface of the top cap. The cross-sectional area of each of the delivery channels remains substantially uniform along its respective length. The number of delivery channels is between three and 80.

Improved sealing characteristics are realized by use of yet another top cap in the spin pot of the present invention or in conjunction with a spin pack assembly. In this embodiment, a plate has a recess in its top surface through which there are a plurality of orifices. The top cap comprises a projection and at least one flow inlet passage. The projection extends from the lower surface of the top cap and has the same general shape externally as the recess. The projection has a depressed portion at its lower face which leaves a peripheral portion of the projection to bear on the peripheral portion of the recess. The top cap is positioned with the projection within the recess of the plate and with the peripheral portion of the projection bearing on the peripheral portion of the recess. The portion of the lower surface of the top cap which surrounds the projection bears on the top surface of the plate. The flow inlet passage is connected at one end to a polymer source, and discharges at its other end to the distribution space formed above the plate by the depressed portion.

In a preferred embodiment, the spin pot of the present invention is used for the extrusion of one or simultaneously more than one ends of multifilament, synthetic fiber. The essential elements are flange means, a spinnerette plate, a breaker plate, sealing means for providing a sealed distribution space between the spinnerette plate and breaker plate, a conventional filter assembly, a top cap, and means for connecting the flange means, breaker plate, and top cap. The spinnerette plate has a plurality of extrusion orifices therethrough and is supported by the flange means. The breaker plate, which has a recess in its top surface, has a plurality of orifices therethrough which are confined to that portion whose top surface is defined by the recess. The breaker plate is positioned substantially parallel to and above the spinnerette plate. The conventional filter assembly is placed in and covers the recess in the top surface of the breaker plate. The top cap comprises a projection, a flow inlet passage, and a plurality of polymer delivery channels. The projection extends from the lower surface of the top cap and has the same general shape externally as the recess. The projection also has a depressed portion at its lower face which leaves a peripheral portion of the projection to bear on the peripheral binder of the filter assembly. The top cap is positioned with the projection within the recess of the breaker plate and with the peripheral portion of the projection bearing on the peripheral binder of the filter assembly. The depressed portion of the projection forms a distribution space between the top cap and the filter assembly. The portion of the lower surface of the top cap which surrounds the projection bears on the top surface of the breaker plate. The flow inlet passage brings molten polymer to an area, the central axis of which substantially coincides with the central axis of the top cap. A plurality of substantially identical polymer delivery channels communicate with the flow inlet passage at this area and branch radially therefrom at substantially equal intervals through the top cap to open on the distribution space formed by the depressed portion of the projection. The cross-sectional area of each of the delivery channels remains substantially uniform along its respective length. The number of delivery channels is between three and 18, and the ratio of the number of delivery channels to twice the distance in inches between the central axis and the inner edge of any one of the delivery channels at the depressed portion is between 1 to 2 and 3 to 1. The delivery channels open into the distribution space at the depressed portion in the peripheral 30% of the top cap above the distribution space. The sum of the cross-sectional areas of the delivery channels is substantially the same as the cross-secional area of the flow inlet passage. The means for connecting the flange means, the breaker plate, and the top cap passes through their respective peripheral boundaries only. Plug flow is achieved throughout the passage of polymer through a spin pot of this improved design. Although the spin pot of the present invention is unusually efficient for the extrusion of a single end of multifilament, synthetic fiber, it is especially well suited for the extrusion of multiple ends of multifilament, synthetic fiber. For adaptation to multiple end spinning, it is necessary only to replace a conventional spinnerette plate with a multiple end spinnerette plate. Preferably, the spinnerette plate for multiple end spinning comprises at least two symmetrical segments having a plurality of extrusion orifices therethrough. Each of the segments has a boundary defined by imperforate portions of the spinnerette plate, at least one of the imperforate portions including the periphery of the spinnerette plate. It is most desirable to orient the spinnerette plate with respect to the top cap so that approximately the same number of delivery channels in the top cap open on the distribution space in each of the areas which vertically define each of the segments.

DETAILED DESCRIPTION OF THE DRAWINGS

Figure 1:
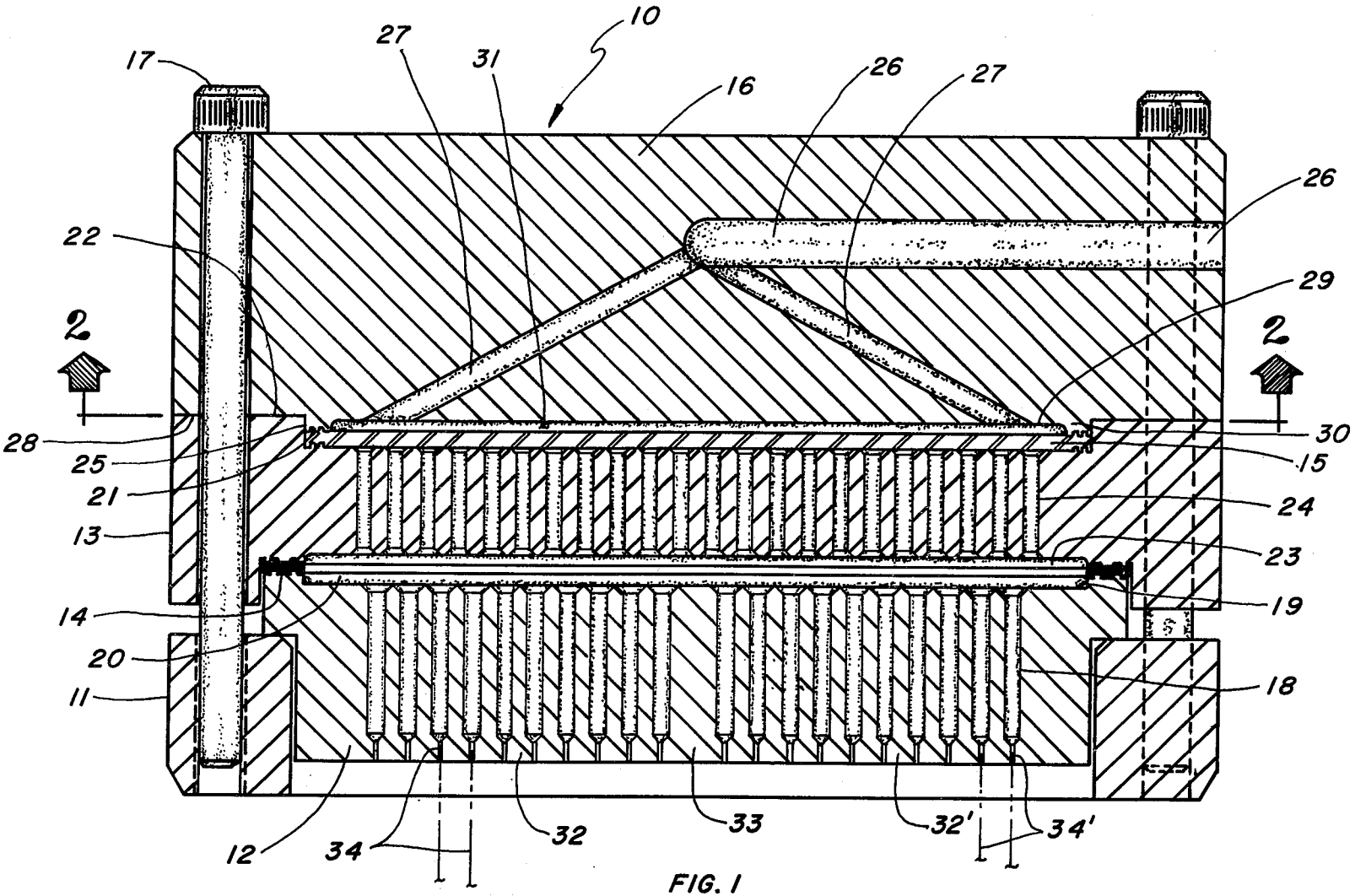
FIG. 1 is a vertical section taken through the center of the spin pot comprising the present invention.

Referring to the drawings, wherein a preferred embodiment is illustrated in FIG. 1, the spin pot of the present invention is designated broadly by the numeral 10 and includes, as the major elements thereof, flange means 11, spinnerette plate 12, breaker plate 13, sealing means 14, filter assembly 15, and top cap 16.

Top cap 16 and filter assembly 15 are designed and positioned so as to form distribution space 31 therebetween. Breaker plate 13 and spinnerette plate 12 are also designed and positioned so as to form a distribution space 20 therebetween. Details of design will be more fully explained hereafter. The spin pot 10 of the present invention can be used for the extrusion of one or simultaneously more than one ends of multifilament, synthetic fiber, depending on the spinnerette plate 12 employed. In multiple end spinning, the number of extrusion orifices 18 increases while the dimensions of spinnerette plate 12 remain substantially unchanged. To prevent problems arising in the quench zone from crowding of the filaments, the internal wetted area of spin pot 10 has been maximized. This is accomplished by eliminating the conventional, cup-shaped spin pack body and then sandwiching the major elements of spin pot 10 together to be connected via some means such as a plurality of bolts 17, through the peripheries only of top cap 16, breaker plate 13, and flange means 11, respectively. Flange means 11 may be, for example, a conventional clamp ring assembly as depicted in the drawings, and its function is twofold. First, flange means 11 supports spinnerette plate 12, and second, flange means 11 is adapted to receive bolts 17 instead of spinnerette plate 12. It is preferred that neither the holes in breaker plate 13 and top cap 16 through which the bolts 17 pass nor that portion of the bolts 17 passing therethrough be threaded. Threads are preferably found only in flange means 11 and that portion of the bolts 17 passing therein, as flange means 11 is the cheapest and most easily replaced element of spin pot 10, should the bolt threads become damaged during operation. Due to the ease with which spinnerette plate 12 might become damaged during normal operation of spin pot 10, it is also preferred that no bolts 17 pass through or thread into spinnerette plate 12. Bolts 17 reside in the area formerly occupied by a spin pack body. Due to the added support provided by enlarging the peripheries of top cap 16, breaker plate 13, and spinnerette plate 12, the internal wetted area of spin pot 10 can be expanded. Surprisingly, no further means of support or connection are necessary inside spin pot 10 and thus, there are no dead or stagnant zones created thereby.

Spinnerette plate 12 is designed for the simultaneous extrusion or two multifilament continuous ends 34 and 34'. However, spin pot 10 is readily adapted for extrusion of more or less multifilament continuous ends by simple substitution of spinnerette plates. Spinnerette plate 12, which has a recess 19 in its top surface, comprises two symmetrical segments 32 and 32', each of which has a plurality of extrusion orifices 18 therethrough which are confined to that portion whose top surface is defined by recess 19. The boundary of each of segments 32 and 32' is defined by an imperforate portion 33 of spinnerette plate 12 and the imperforate periphery of spinnerette plate 12. As mentioned previously, spinnerette plate 12 is supported by flange means 11.

Breaker plate 13 has a first recess 21 in its top surface 22 and a second recess 23 in its lower surface, both having approximately the same peripheral boundary as recess 19 in spinnerette plate 12. There are a plurality of orifices 24 through breaker plate 13 which are confined to that portion whose top surface is defined by first recess 21 and whose bottom surface is defined by second recess 23. Breaker plate 13 is positioned substantially parallel to and above spinnerette plate 12 so that their respective recesses, 23 and 19, are substantially in alignment and form distribution space 20 therebetween. Sealing means 14 is located between the non-recessed, parallel surfaces of breaker plate 13 and spinnerette plate 12 to seal distribution space 20 therebetween. Conventional filter assembly 15 is placed in and covers recess 21 in the top surface 22 of breaker plate 13.

Top cap 16 comprises a projection 25, a flow inlet passage 26, and a plurality of polymer delivery channels 27. Projection 25 extends from the lower surface 28 of top cap 16 and has the same general shape externally as recess 21. Projection 25 has a depressed portion 29 at its lower face which leaves a peripheral portion 30 of projection 25 to bear on the peripheral binder of filter assembly 15. Top cap 16 is positioned with projection 25 within recess 21 of breaker plate 13 and with peripheral portion 30 of projection 25 bearing on the peripheral binder of filter assembly 15. Depressed portion 29 of projection 25 forms a distribution space 31 between top cap 16 and filter assembly 15. The portion of the lower surface 28 of top cap 16 which surrounds projection 25 bears on the non-recessed top surface 22 of breaker plate 13.

Figure 2:
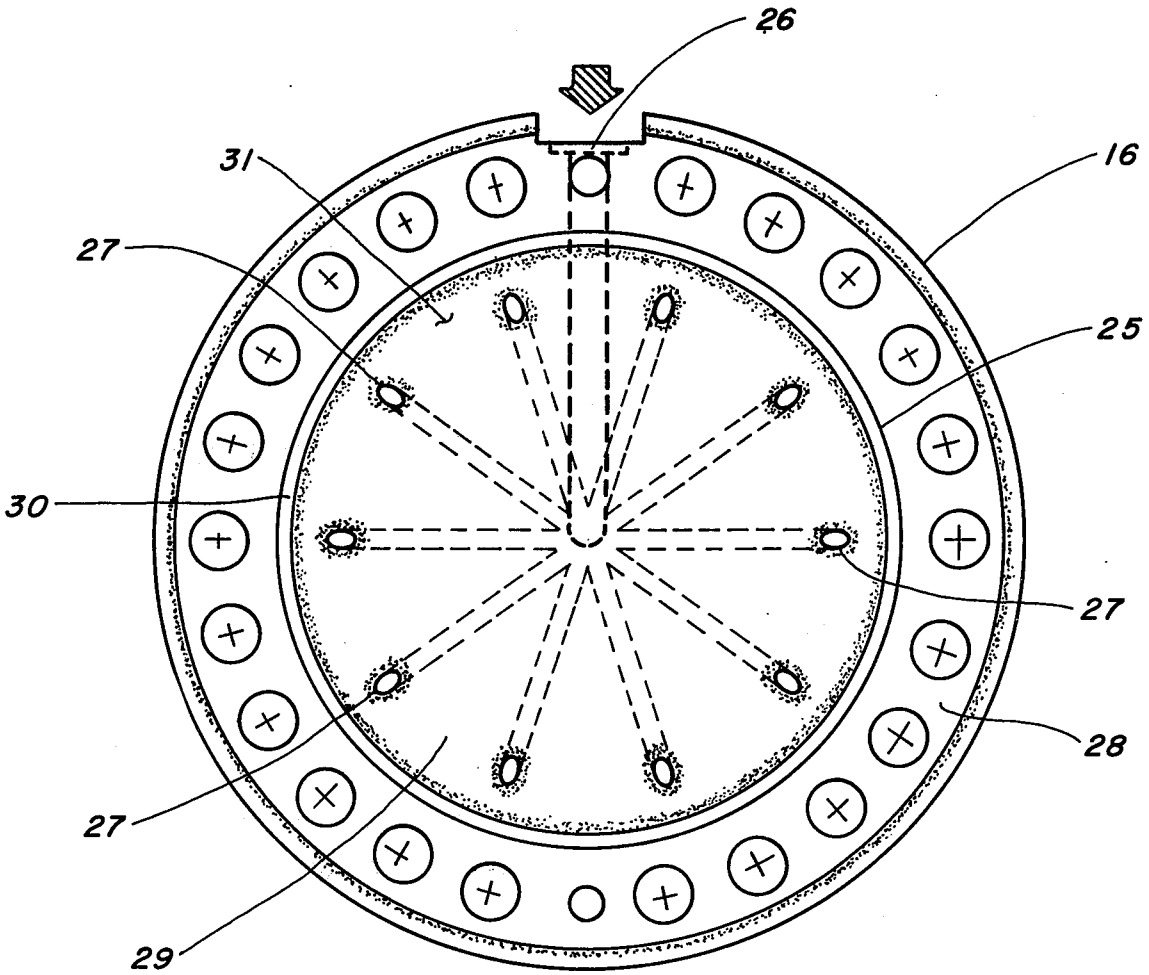
FIG. 2 is a view taken on line 2—2 of FIG. 1.

Top cap 16 has means thereon adapted for connection to a polymer source (not shown) and a flow inlet passage 26 which can, as shown in FIG. 1, be horizontally disposed and which brings molten polymer to an area, the central axis of which substantially coincides with the central axis of top cap 16. A plurality of substantially identical polymer delivery channels 27 communicate at this area with flow inlet passage 26 and branch radially therefrom at substantially equal intervals through top cap 16 to open on distribution space 31. The cross-sectional area of each of delivery channels 27 remains substantially uniform along its respective length, with the sum of the cross-sectional areas of delivery channels 27 being substantially the same as the cross-sectional area of flow inlet passage 26. The number of delivery channels 27 is between three and 80, and the ratio of the number of delivery channels 27 to twice the distance in inches between the central axis and the inner edge of any one of the delivery channels 27 at the depressed portion 29 is between 1 to 2 and 3 to 1 (see FIG. 2). It is most preferred that the number of delivery channels be between three and 18. Delivery channels 27 open into distribution space 31 at depressed portion 29 in the peripheral 50% of the cross-sectional area of top cap 16 above distribution space 31, and more preferably in the peripheral 30%. It is optional, but preferred, that spinnerette plate 12 be oriented with respect to top cap 16 so that the same number of delivery channels 27 open on distribution space 31 in each of the areas which vertically define each of the segments 32 and 32' of spinnerette plate 12.

The operation of spin pot 10 is as follows with reference to FIG. 1. Molten polymer flows under high pressure into top cap 16 through flow inlet passage 26. The polymer then branches equally to flow through delivery channels 27. As delivery channels 27 are of the same length and cross-sectional area, molten polymer flows therethrough under identical pressures and with identical residence times to be uniformly distributed into distribution space 31. At distribution space 31, the flow of the molten polymer is substantially laminar, and the face of filter assembly 15 is evenly coated. From filter assembly 15, the polymer flows through orifices 24 of breaker plate 13 to sealed distribution space 20, and on to extrusion orifices 18 in segments 32 and 32' of spinnerette plate 12, from which two multi-filament continuous ends, 34 and 34', are spun.

The pressure of the tightened bolts 17 causes peripheral portion 30 of projection 25 to come into fluid-tight relationship with the peripheral binder of filter assembly 15, and to thereby seal distribution space 31. This prevents polymer from either collecting on the peripheral binder of filter asssembly 15 or leaking to the exterior of spin pot 10.

As mentioned previously, the sum of the cross-sectional areas of delivery channels 27 at depressed portion 29 is substantially the same as the cross-sectional area of flow inlet passage 27. This causes the velocity of the polymer to remain constant through top cap 16. For this reason, a diverging circumferential delivery channel, such as the type formed by the gap left in an inverted cone is placed within an inverted cone, has been avoided. The narrowness of the gap of a diverging circumferential delivery channel at the point of discharge would create a weak point at the apex of the cone which would require added support. Although a bolt can furnish this needed support, it would also furnish an extra piece of equipment having narrow tolerances. Further, the high volume of thin film being distributed would be subject to local overheating and temperature gradients.

Distribution space 20 between breaker plate 13 and spinnerette plate 12 can be formed, alternately, by leaving the lower surface of breaker plate 13 and the upper surface of spinnerette plate 12 non-recessed, and interposing sealing means therebetween. Also optional, but preferred, is the countersinking of orifices 24 on the discharge side of breaker plate 13. This prevents entrapment of gases above spinnerette plate 12 and promotes uniform filling of distribution space 20.

The actual free volume of improved top cap 16, i.e. the volume through which polymer flows, is substantially less than the volume of top caps having an essentially conic type of delivery. The free volume of a spin pot below either of these top caps is usually constant. Due to this decrease of free volume in top cap 16, the residence time of polymer flowing therethrough is considerably less, and as a consequence, thermal degradation of the polymer due to residence time lessens also.

By way of comparison, molten polymer was supplied at the same throughput rate to two spin pots. The first spin pot had a top cap with a conic type of delivery and a total free volume of 1500 cc. The second spin pot had a top cap as described in the preferred embodiment, with 10 polymer delivery channels and a total free volume of 500 cc. The 1000 cc. difference in free volume between these two spin pots resides in the design of the top caps. Two equivalents of free volume were supplied to each of the spin pots, i.e. 3000 cc. to the first spin pot having a top cap with a conic type of delivery, and 1000 cc. to the second spin pot comprising the preferred embodiment of the present invention. The average polymer residence time for the first spin pot was 6 minutes, with a 90% exchange of material. Surprisingly, the average polymer residence time for the second spin pot was only 2 minutes, with a greater than 99% exchange of material. For the first spin pot, there is only a 50% exchange of material for the first 1000 cc. initially supplied. Considering this in conjunction with the fact that it takes 6 minutes at a given throughput rate to achieve a 90% exchange of material in a 1500 cc. spin pot, it is obvious that this first spin pot is overwhelmingly less efficient than the second spin pot. The reduced volume of the spin pot of the present invention reduces the polymer residence time while achieving said greater than 99% exchange of material.

The materials of construction of the apparatus are not critical and may be selected from any materials that are known to be satisfactory for the extrusion of molten polymer, for example, corrosion resistant steel.

It should also be noted that the top cap 16 of spin pot 10 can be used in conjunction with spin pack assemblies of differing designs, and that its unusual external, or sealing, design is independent of its internal, or delivery, design.

While the invention has been described primarily in conjunction with the extrusion of two ends of continuous multifilament fiber, it is not intended to exclude extrusion of more or less ends of continuous multifilament fiber. Various modifications and other advantages will be apparent to one skilled in the art, and it is intended that this invention be limited only as set forth in the following claims.

What is claimed is:

1. A spin pot for the extrusion of one or simultaneously more than one ends of multifilament, synthetic fiber, comprising in combination:

A. flange means;

B. a spinnerette plate, said spinnerette plate having a plurality of extrusion orifices therethrough and being supported by said flange means;

C. a breaker plate with a recess in its top surface, said breaker plate having a plurality of orifices therethrough which are confined to that portion whose top surface is defined by said recess, said breaker plate being positioned substantially parallel to and above said spinnerette plate;

D. sealing means for providing a sealed distribution space between said breaker plate and said spinnerette plate and being located therebetween;

E. a conventional filter assembly, said filter assembly being placed in and covering said recess in said top surface of said breaker plate;

F. a top cap, said top cap comprising:

1. a projection, said projection extending from the lower surface of said top cap and having the same general shape externally as said recess, said projection having a depressed portion at its lower face leaving a peripheral portion of said projection to bear on the peripheral binder of said filter assembly, said top cap being positioned with said projection within said recess of said breaker plate, said peripheral portion of said projection bearing on said peripheral binder of said filter assembly, said depressed portion of said projection forming a distribution space between said top cap and said filter assembly, the portion of said lower surface of said top cap surrounding said projection bearing on said top surface of said breaker plate;

2. a flow inlet passage, said flow inlet passage bringing molten polymer to an area the central axis of which substantially coincides with the central axis of said top cap; and 3. a plurality of substantially identical polymer delivery channels, said delivery channels communicating with said flow inlet passage at said area and branching radially therefrom at substantially equal intervals through said top cap to open on said distribution space formed by said depressed portion of said projection, the cross-sectional area of each of said delivery channels remaining substantially uniform along its respective length, the number of said delivery channels being between three and 18 and the ratio of said number of said delivery channels to twice the distance in inches between said central axis and the inner edge of any one of said delivery channels at said depressed portion being between 1 to 2 and 3 to 1, said delivery channels opening into said distribution space at said depressed portion in the peripheral 30% of said top cap above said distribution space, the sum of the cross-sectional areas of said delivery channels being substantially the same as the cross-sectional area of said flow inlet passage; and G. means for connecting said flange means, said breaker plate, and said top cap through their respective peripheral boundaries only; whereby plug flow is achieved throughout the passage of polymer through said spin pot.

2. The spin pot of claim 1 wherein said spinnerette plate comprises at least two symmetrical segments having a plurality of extrusion orifices therethrough and each having a boundary defined by imperforate portions of said spinnerette plate, at least one of said imperforate portions including the periphery of said spinnerette plate, and wherein said spinnerette plate is oriented with respect to said top cap so that approximately the same number of said delivery channels in said top cap open on said distribution space in each of the areas which vertically define each of said segments.

3. A top cap, for use in conjunction with a spin pack assembly for the extrusion of synthetic filaments, comprising:

A. a flow inlet passage, said flow inlet passage bringing molten polymer to an area the central axis of which substantially coincides with the central axis of said top cap; and B. a plurality of substantially identical polymer delivery channels, said delivery channels communicating with said flow inlet passage at said area and branching radially therefrom at substantially equal intervals through said top cap to open at the lower surface of said top cap into a distribution space for said spin pack assembly, the cross-sectional area of each of said delivery channels remaining substantially uniform along its respective length, the number of said delivery channels being between three and 80 and the ratio of said number of said delivery channels to twice the distance in inches between said central axis and the inner edge of any one of said delivery channels at said lower surface of said top cap being between 1 to 2 and 3 to 1, said delivery channels opening in the peripheral 50% of said bottom surface which is disposed above the internal wetted area of said distribution space for said spin pack assembly, the sum of the cross-sectional areas of said delivery channels being substantially the same as the cross-sectional area of said flow inlet passage;

whereby molten polymer flows through said top cap under identical pressures and with identical residence times to be uniformly distributed into said distribution space where the flow of said molten polymer is substantially laminar.

4. The top cap of claim 3 wherein the number of said delivery channels is between three and 18.

5. The top cap of claim 3 wherein said delivery channels open into said distribution space in the peripheral 30% of said bottom surface which is disposed thereabove.

6. The top cap of claim 3 in combination with a spin pack assembly which comprises a spinnerette plate with at least two symmetrical segments having a plurality of extrusion orifices therethrough and each having a boundary defined by imperforate portions of said spinnerette plate, at least one of said imperforate portions including the periphery of said spinnerette plate, and wherein said spinnerette plate is oriented with respect to said top cap so that the plane of said spinnerette plate is downstream of and approximately parallel to said bottom surface of said top cap and so that approximately the same number of said delivery channels in said top cap open on said distribution space in each of the areas which vertically define each of said segments.

7. The top cap of claim 3 in combination with a spin pack assembly which comprises a plate with a recess in the top surface thereof through which there are a plurality of orifices and wherein said bottom surface of said top cap has a projection extending therefrom which has the same general shape externally as said recess, said projection having a depressed portion at its lower face leaving a peripheral portion of said projection to bear on the peripheral portion of said recess, said top cap being positioned with said projection within said recess of said plate and with said peripheral portion of said projection bearing on said peripheral portion of said recess, the portion of said lower surface of said top cap surrounding said projection bearing on said top surface of said plate, said distribution space being formed above said plate by said depressed portion.

8. The apparatus of claim 7 wherein the number of said delivery channels is between three and 18.

9. The apparatus of claim 7 wherein said delivery channels open into said distribution space at said depressed portion in the peripheral 30% of said top cap above said distribution space.

10. The apparatus of claim 7 wherein said spin pack assembly comprises a spinnerette plate with at least two symmetrical segments having a plurality of extrusion orifices therethrough and each having a boundary defined by imperforate portions of said spinnerette plate, at least one of said imperforate portions including the periphery of said spinnerette plate, and wherein said spinnerette plate is oriented with respect to said top cap so that the plane of said spinnerette plate is downstream of and approximately parallel to said bottom surface of said top cap and so that approximately the same number of said delivery channels in said top cap open on said distribution space in each of the areas which vertically define each of said segments.

11. The apparatus of claim 7 wherein said plate is a breaker plate and wherein a filter assembly having a peripheral binder is placed in said recess between said breaker plate and said top cap, said peripheral portion of said projection bearing on said peripheral binder of said filter assembly.

* * * * *